US011109137B2

(12) United States Patent
Ito et al.

(10) Patent No.: US 11,109,137 B2
(45) Date of Patent: Aug. 31, 2021

(54) HEADPHONE

(71) Applicant: SONY CORPORATION, Tokyo (JP)

(72) Inventors: Tomohiro Ito, Tokyo (JP); Yuzo Ozaki, Kanagawa (JP); Mizuki Shimamura, Saitama (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/498,719

(22) PCT Filed: Feb. 28, 2018

(86) PCT No.: PCT/JP2018/007459
§ 371 (c)(1),
(2) Date: Sep. 27, 2019

(87) PCT Pub. No.: WO2018/186062
PCT Pub. Date: Oct. 11, 2018

(65) Prior Publication Data

US 2020/0053449 A1 Feb. 13, 2020

(30) Foreign Application Priority Data

Apr. 4, 2017 (JP) ..... JP2017-074313

(51) Int. Cl.
*H04R 1/10* (2006.01)
*H04R 9/06* (2006.01)
*H04R 11/02* (2006.01)

(52) U.S. Cl.
CPC ..... *H04R 1/1016* (2013.01); *H04R 1/105* (2013.01); *H04R 9/06* (2013.01); *H04R 11/02* (2013.01)

(58) Field of Classification Search
CPC ..... H04R 1/1016; H04R 1/105; H04R 9/06; H04R 11/02; H04R 1/345; H04R 2420/07; H04R 2499/15; H04R 5/0335
See application file for complete search history.

(56) References Cited

U.S. PATENT DOCUMENTS

2004/0156012 A1* 8/2004 Jannard ..... G02C 11/10 351/158
2005/0201585 A1* 9/2005 Jannard ..... G02C 11/10 381/381
2006/0132382 A1* 6/2006 Jannard ..... G02B 27/017 345/8
2011/0135120 A1* 6/2011 Larsen ..... H04R 1/1016 381/151

FOREIGN PATENT DOCUMENTS

CN 104602151 5/2015
CN 105792045 7/2016
(Continued)

OTHER PUBLICATIONS

International Search Report prepared by the Japan Patent Office dated May 9, 2018, for International Application No. PCT/JP2018/007459.

(Continued)

*Primary Examiner* — Tuan D Nguyen
(74) *Attorney, Agent, or Firm* — Sheridan Ross P.C.

(57) ABSTRACT

A headphone includes a sound emission unit supported by a temple included in a glass portion including a display and/or a lens and to be inserted into a concha cavity of a user's ear.

20 Claims, 8 Drawing Sheets

(56) References Cited

FOREIGN PATENT DOCUMENTS

| | | |
|---|---|---|
| JP | S58-85899 | 6/1983 |
| JP | 2005-167902 | 6/2005 |
| JP | 6122229 | 7/2018 |

OTHER PUBLICATIONS

Official Action (with English translation) for Chinese Patent Application No. 201880021846.X, dated Dec. 23, 2020, 10 pages.
Official Action (with English translation) for Chinese Patent Application No. 201880021846.X, dated Mar. 8, 2021, 13 pages.

* cited by examiner

HEADPHONE

CROSS REFERENCE TO RELATED APPLICATIONS

This application is a national stage application under 35 U.S.C. 371 and claims the benefit of PCT Application No. PCT/JP2018/007459 having an international filing date of 28 Feb. 2018, which designated the United States, which PCT application claimed the benefit of Japanese Patent Application No. 2017-074313 filed 4 Apr. 2017, the entire disclosures of each of which are incorporated herein by reference.

TECHNICAL FIELD

The present technology relates to a headphone.

BACKGROUND ART

In recent years, various display devices for augmented reality (AR) and virtual reality (VR) have been announced, and evolution to a so-called smart glass which is a glass-type head mounted display is expected in the future. As a keyword of such a glass-type device, "always wearing" is mentioned. The always wearing means to wear the device basically at any time when a user does anything, for example, when the user is at home, goes outside, and the like.

In a case where the user listens to music and the like outside, a headphone (earphone) and the like of which earpieces are inserted into ears is used, and a grass-type device using the above headphone has been proposed (Patent Document 1).

CITATION LIST

Patent Document

Patent Document 1: Japanese Patent Application Laid-Open No. 2006-186756

SUMMARY OF THE INVENTION

Problems to be Solved by the Invention

However, when the earpieces are inserted into the ears to listen to sound output by such an always-wearing device, it is difficult to have a conversation while listening to the sound from the glass-type device. Furthermore, there is a problem in that it is difficult to detect approach of a car or the like by listening to surrounding sounds. Furthermore, a simple configuration for quick and easy attachment and detachment and for a small and light structure is required.

The present technology has been made in view of such problems, and an object of the present technology is to provide a headphone that can listen to external sound while listening to sound from a device for outputting sound and is easily and instantly attached and detached.

Solutions to Problems

To solve the above problems, the present technology is a headphone including a sound emission unit supported by a temple included in a glass portion including a display and/or a lens and to be inserted into a concha cavity of a user's ear.

Effects of the Invention

According to the present technology, it is possible listen to external sound while listening to sound output from a device and to be easily and instantly attached and detached. Note that the effects described herein are not necessarily limited and that the effect may be any effects described in the specification.

MODE FOR CARRYING OUT THE INVENTION

Embodiments of the present technology will be described below with reference to the drawings. Note that, the description will be made in the following order.

<1. First Embodiment>
[1-1. Configuration of Smart Glass]
[1-2. Configuration of Headphone]
<2. Second Embodiment>
[2-1. Configuration of Headphone]
<3. Modification>

1. First Embodiment

[1-1. Configuration of Smart Glass]

Figure 1:
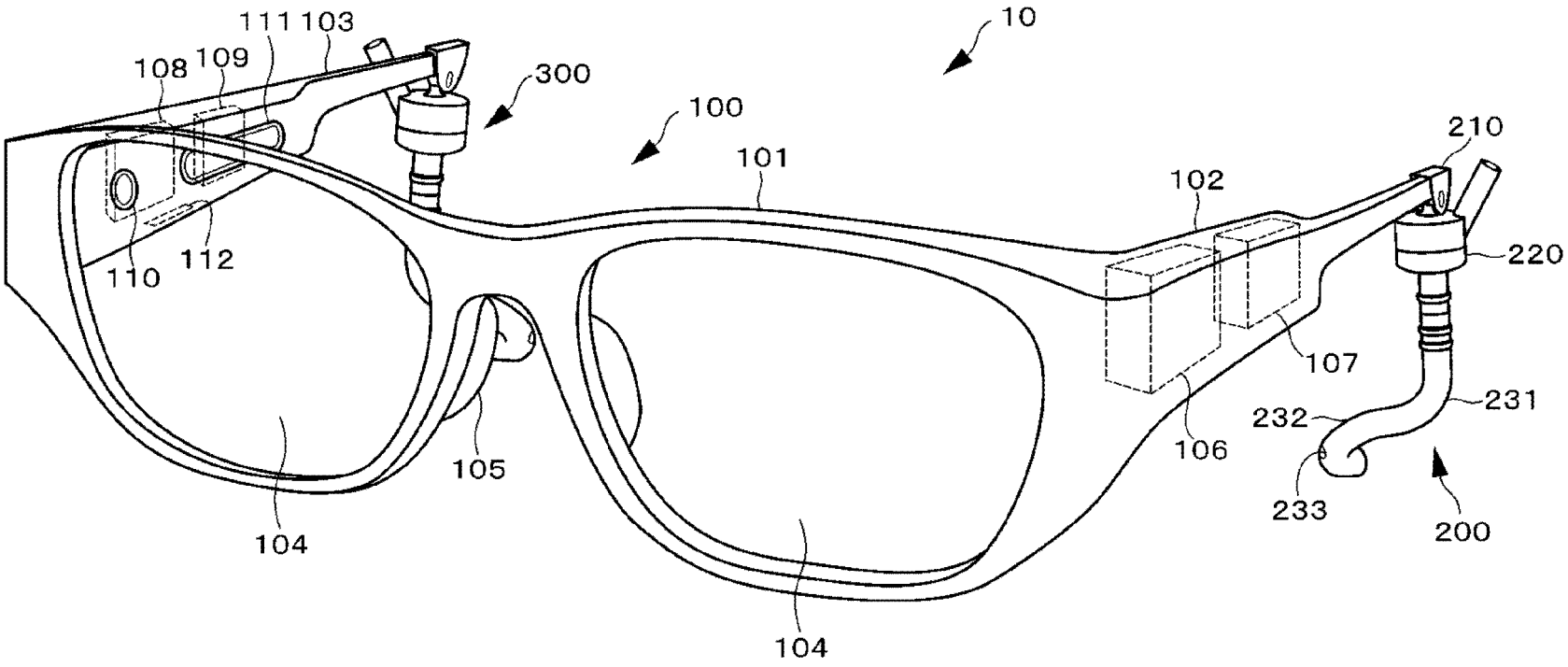
FIG. 1 is a perspective view illustrating a configuration of a smart glass including headphones.

First, a configuration of a smart glass 10 which is a wearable device including headphones according to a first embodiment will be described. FIG. 1 is a perspective view illustrating an appearance configuration of the smart glass 10.

The smart glass 10 includes a glass portion 100, a left-side headphone 200, a right-side headphone 300 and is configured as a transmissive smart glass. The smart glass 10 has a glass-like shape as a whole, and a user can wear the smart glass 10 as visually recognizing the outside world and can obtain various information such as an image, a video, and the like to be displayed.

The glass portion 100 includes a rim 101, a left-side temple 102, a right-side temple 103, and displays 104. The rim 101 is formed to support the displays 104 so as to be correspondingly provided to the left and right eyes of the user. Furthermore, at the center of the rim 101, a nose pad 105 is formed which has contact with an upper portion of the nose of the user so as to support the smart glass 10 when the user wears the smart glass 10.

The display 104 can present an image (including an icon, a video, and the like) to the user. The display 104 includes a lens as an optical member and a display element. In the display 104, the display element forms an image, and image light of the image is guided into the optical member and emitted into the eyes of the user so that the image is presented to the user. In both cases where the image is displayed on the displays 104 and where the image is not displayed on the displays 104, the user can visually recognize the outside through the lens of the display 104.

One end side of the left-side temple 102 is connected to the left end of the rim 101, another end portion is connected to the left-side headphone 200. One end side of the right-side temple 103 is connected to the right end of the rim 101, and another end portion is connected to the right-side headphone 300. The left-side temple 102 and the right-side temple 103 play a role for supporting the smart glass 10 by sandwiching both sides of the head of the user when the user wears the smart glass 10. The rim 101, the left-side temple 102, and the right-side temple 103 are formed by using, for example, materials such as synthetic resin and metal.

The left-side temple 102 and the right-side temple 103 are formed to be curved, for example, by having flexibility and applying a force so that a distance between the left-side temple 102 and the right-side temple 103 is widened. The user can easily wear the smart glass 10 by widening the distance between the left-side temple 102 and the right-side temple 103 at the time when the smart glass 10 is worn and is operated.

A battery 106 and a Near Field Communication (NFC) module 107 are contained in the left-side temple 102.

The battery 106 includes, for example, a lithium secondary battery and a battery control circuit which controls charging and discharging and supplies power to each unit of the smart glass 10.

The NFC module 107 is a communication module which performs near field communication with an external device such as a personal computer, a smartphone, a tablet terminal, and a router.

A control unit 108, a storage unit 109, and the like are contained in the right-side temple 103.

The control unit 108 includes a Central Processing Unit (CPU), a Random Access Memory (RAM), a Read Only Memory (ROM), and the like. The ROM stores a program to be read and operated by the CPU and the like. The RAM is used as a work memory of the CPU. The CPU controls the whole smart glass 10 by executing various processing according to the program stored in the ROM and issuing a command.

The storage unit 109 is a mass storage medium including a semiconductor memory and the like. The storage unit 109 stores an application, a program, content, and the like to be executed by the control unit 108.

An operation unit is provided on an inner surface of the right-side temple 103. In the present embodiment, as the operation unit, a power button 110 which turns on/off the smart glass 10 and a volume adjustment button 111 which adjusts the volume of the sound output from the headphones are provided.

Moreover, an external input/output terminal 112 is provided on the lower surface of the right-side temple 103. The external input/output terminal 112 exchanges data with an external device by Universal Serial Bus (USB) communication and the like. Note that, in a case where a USB is used as the external input/output terminal 112, power is supplied to the battery 106 via the external input/output terminal 112. Note that the communication between the smart glass 10 and the external device is not limited to the USB communication and may be High-Definition Multimedia Interface (HDMI) (registered trademark) communication and the like. Furthermore, the above communication may be wireless communication such as wireless Local Area Network (LAN) such as Wi-Fi, the Bluetooth (registered trademark), and the ZigBee.

Note that the left-side temple 102 and the right-side temple 103 may be configured integrally with the rim 101 and may be formed to be foldable by connecting the left-side temple 102 and the right-side temple 103 to the rim 101 with hinges as separate members from the rim 101.

In a normal glass-type smart glass 10, moderns hanging on the user's ears are provided at the other ends of the left-side temple 102 and the right-side temple 103. However, in the smart glass 10 according to the present embodiment, the modern is not provided. This will be described in detail later.

[1-2. Configuration of Headphone]

Figure 2:
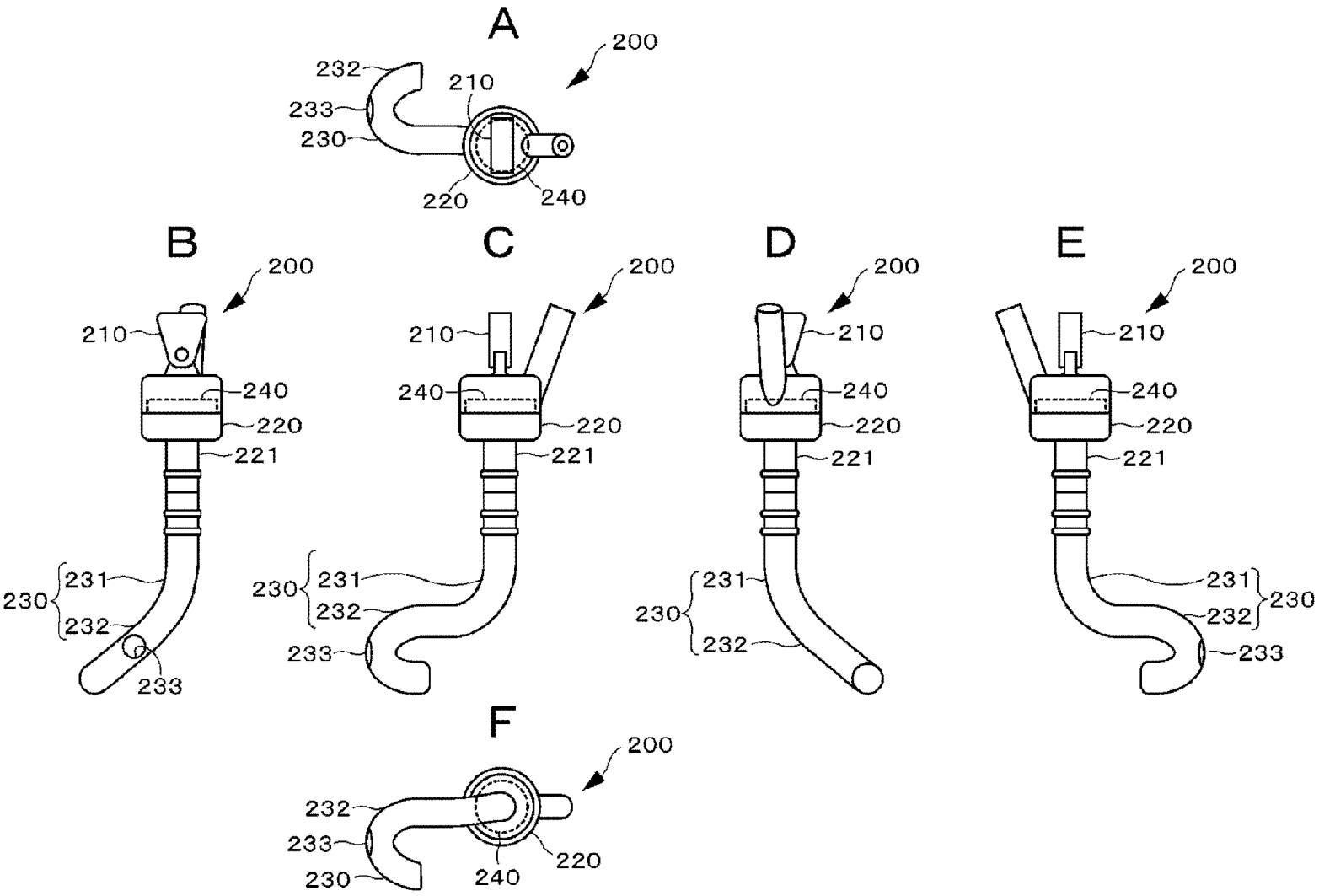
FIG. 2 is a six-sided view of the headphone.

Next, the headphone will be described with reference to FIGS. 2 to 4. Note that the headphone includes the left-side headphone 200 and the right-side headphone 300, and the description will be made with reference to the left-side headphone 200. The configurations of the left-side headphone 200 and the right-side headphone 300 are the same except that both headphones are symmetrical.

The left-side headphone 200 and the right-side headphone 300 are connected to the control unit 108 via a control line (not illustrated) which passes through the inside of the glass portion 100 and a sound transmission line.

FIG. 2A is a top view of the left-side headphone 200, FIG. 2B is a front view of the left-side headphone 200, FIGS. 2C and 2E are side views in a case where FIG. 2B is the front view of the left-side headphone 200, FIG. 2D is a back view in a case where FIG. 2B is the front view of the left-side headphone 200, and FIG. 2F is a bottom view.

The left-side headphone 200 includes a hinge portion 210, a housing 220, a sound emission unit 230.

The hinge portion 210 rotatably supports the left-side headphone 200 at the other end of the left-side temple 102 of the glass portion 100. The left-side headphone 200 can be rotated by the hinge portion 210 so that the sound emission unit 230 of the left-side headphone 200 can be adjusted to have contact with an appropriate position of the user's ear. The hinge portion 210 corresponds to an operation unit in the claims.

An upper end of the housing 220 is supported by the hinge portion 210, and the housing 220 functions as a container which contains a sound processing circuit (not illustrated), a driver unit, and the like therein. The housing 220 is formed by using, for example, a synthetic resin such as plastic, corrosion resistant metal, and the like. For example, the sound processing circuit executes predetermined sound signal processing such as signal amplification processing, equalizing processing, noise canceling processing on a sound signal that drives a speaker. The driver unit and the speaker are sound output units which output the sound signal on which processing is executed by the sound processing circuit as sound.

In the present embodiment, a dynamic-type driver 240 is provided as a driver unit. The dynamic-type driver 240 is provided so that a sound output direction is directed to the sound emission unit 230. At present, as a driver unit having a sound pressure sensitivity sufficient to listen to music having a range of sounds from high notes to low notes, for example, it is desirable to use a dynamic-type driver having a diameter equal to or more than φ6 mm.

A tubular projection 221 for connecting to the sound emission unit 230 is provided on a lower end of the housing 220.

The sound emission unit 230 is connected to the projection 221 so as to be connected to the housing 220. The sound emission unit 230 is formed in a tubular shape having a predetermined curved shape including a first curved portion 231 and a second curved portion 232.

One end of the first curved portion 231 is connected to the projection 221 of the housing 220. Another end side of the first curved portion 231 is curved so that the sound emission unit 230 is inserted into the concha cavity of the user's ear in a state where the user wears the smart glass 10.

The second curved portion 232 and the first curved Portion 231 are integrally formed and are curved to have a substantially U-like shape. The second curved portion 232 is curved to a direction (direction from concha cavity of the user's ear to outside) opposite to the direction in which the first curved portion 231 is inserted into the concha cavity of the user's ear in a state where the user wears the smart glass 10 so as to have a substantially U-like shape.

In the vicinity of a vertex of the substantially U-like curved shape of the second curved portion 232, a sound emission hole 233 passing through from inside of the sound emission unit 230 to the outside is formed. The sound output from the dynamic-type driver 240 is transmitted through the sound emission unit 230 and emitted from the sound emission hole 233 toward an external acoustic opening of the user. This configuration allows the user to listen to the sound output from the headphones.

It is desirable that a curvature of the substantially U-like curved shape of the second curved portion 232 be, for example, larger than a diameter of the sound emission unit 230 and be about the same as a fingertip of a person's index finger, middle finger, or a ring finger. Since the finger is a part of the body familiar to any user, in a case where the curvature is about the same as the human finger, this curvature can provide a sense of safety to the user who uses the smart glass 10.

Figure 3:
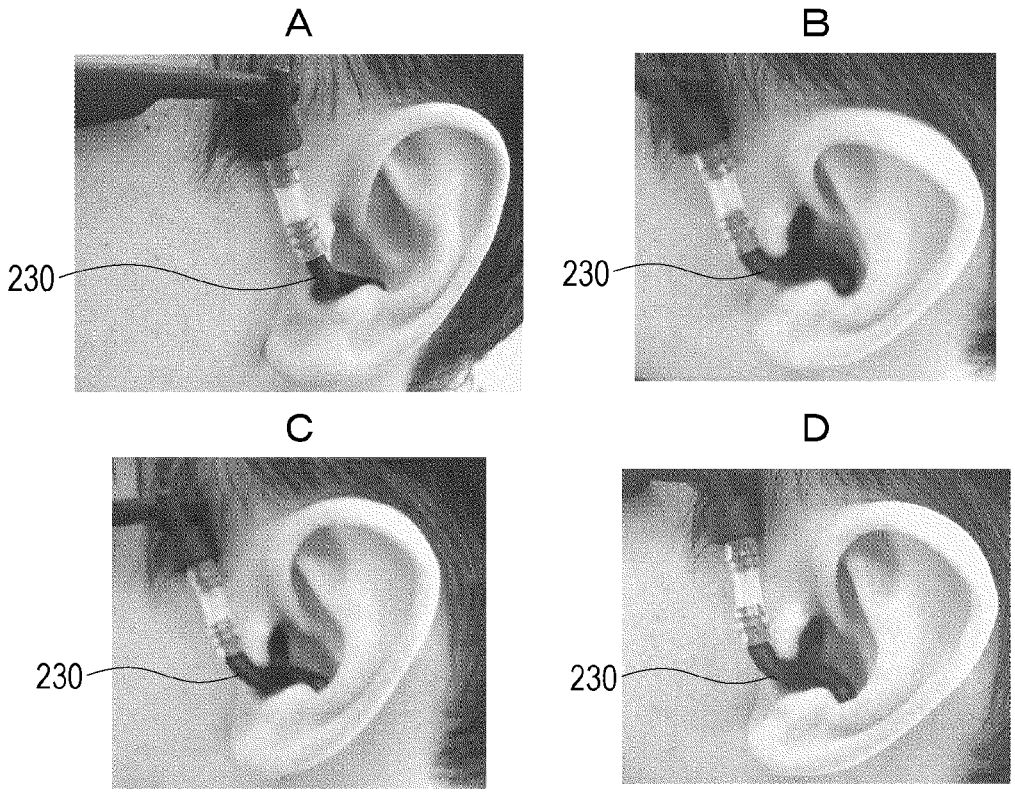
FIG. 3 is a view illustrating a wearing state of the smart glass.

As illustrated in FIG. 3, in a state where the user wears the smart glass 10, the sound emission unit 230 is inserted into the concha cavity of the user's ear inner than a use's ear tragus by the curved shape of the first curved portion 231, and the second curved portion 232 has contact with the concha cavity. Note that, since the sound emission hole 233 is opened toward the external acoustic opening reaches the eardrum of the user, the sound emitted from the sound emission hole 233 is not blocked by the skin of the concha cavity.

A front end of the sound emission unit 230 is formed to be rounded. By rounding the front end of the sound emission unit 230, even a thin sound emission unit 230 can be safely used without being stuck to the face, the ear, and the like of the user and without giving a sense of anxiety.

In a state where the user wears the smart glass 10, the smart glass 10 is supported by the contact of the nose pad 105 with the upper portion of the nose, pinch of the side heads by the temples, and the contact of the sound emission unit 230 with the concha cavity. Therefore, the sound emission unit 230 functions as a sound guide tube for guiding the sound from the dynamic-type driver 240 and also functions as a support mechanism of the smart glass 10.

All or a part (portion having contact with concha cavity of user) of the sound emission unit 230 is formed by a synthetic resin and the like so as to have flexibility. By having flexibility, more comfortable wearing feeling can be obtained, and danger at the time of use can be reduced. Moreover, since the sound emission unit 230 is a thin member, a possibility of deformation and breakage can be more reduced by having flexibility than a case where the sound emission unit 230 includes a rigid member.

Here, a point that the smart glass 10 according to the present embodiment does not include moderns (ear pad portions) which are normally included in glasses or smart glasses will be described.

Figure 4:
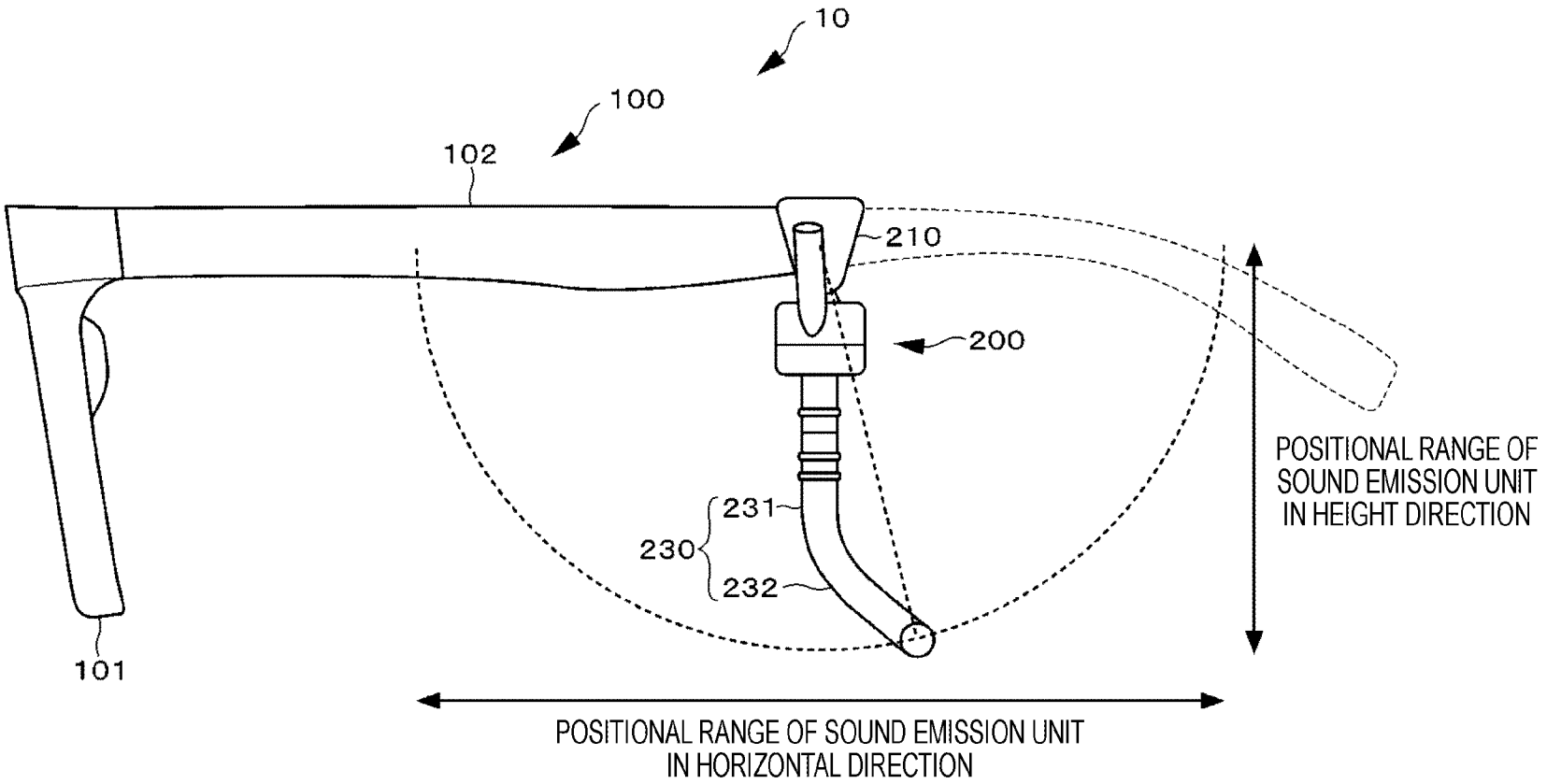
FIG. 4 is a side view of the smart glass for explaining adjustment of a position of a sound emission unit.

FIG. 4 is a side view of the smart glass 10 and indicates a range where the position of the left-side headphone 200 can be adjusted by the rotation of the hinge portion 210. By rotating the left-side headphone 200 by the hinge portion 210, the position of the sound emission unit 230 to be inserted into the concha cavity of the ear can be adjusted.

Since the hinge portion 210 rotates the left-side headphone 200, when the left-side headphone 200 is rotated as illustrated in FIG. 4, the positions of the sound emission unit 230 not only in the horizontal direction but also the height direction are changed. When the position of the sound emission unit 230 in the height direction changes, the modern slightly moves upward from the left-side temple 102. Therefore, the modern is separated from the ear or a contact position between the modern and the ear changes and becomes unstable. While adjusting the position of the sound emission unit 230, the user needs to adjust the position of the modern again. In the present embodiment, by removing the modern of the smart glass 10, disadvantage regarding the modern according to the adjustment of the position of the sound emission unit 230 is eliminated.

Since the sound emission unit 230 has contact with the concha cavity, even when the modern is not provided, the sound emission unit 230, the nose pad 105, and the pinch of the head sides by the temples can support the smart glass 10.

The modern supports the rear side of the smart glass 10 by having contact with the user's ear. However, in the present embodiment, since the sound emission unit 230 has contact with the concha cavity of the ear so as to support the smart glass 10, the lack of the modern does not cause problems such that the smart glass 10 becomes unstable or the like. Note that the removal of the modern contributes to reduce the weight of the smart glass 10.

The headphone according to the first embodiment is configured as described above. According to the first embodiment, since the sound emission hole 233 of the sound emission unit 230 supplies the sound to the user without blocking the external acoustic opening reaching the eardrum, the user can listen to external sound while listening to the sound output from the smart glass 10. Therefore, while listening to the sound output from the smart glass 10, the user can talk to a person and pay attention to the surroundings. Furthermore, the sound emission unit 230 is inserted into the concha cavity and emits sound toward the external acoustic opening. Therefore, leakage of sound is minimized, and there is no possibility to cause trouble to the surroundings.

Furthermore, the sound emission unit 230 is formed to have a curved shape including the first curved portion 231 which is curved toward the concha cavity of the user and the substantially U-like second curved portion 232 having contact with the concha cavity of the user. Therefore, the sound emission unit 230 functions as a support mechanism of the headphone and the smart glass.

Furthermore, since the hinge portion 210 and the tubular sound emission unit 230 having flexibility can maintain an appropriate position according to various ear shapes with individual differences, the smart glass 10 is optimal for comfortable and long-time listening. Moreover, while the sound emission unit 230 fits to various ears of users and is thin so as not to be an obstacle, the sound emission unit 230 has a substantially U shaped curve R, and the front end portion of the sound emission unit 230 is not pointed. Therefore, the sound emission unit 230 does not provide the user a sense of anxiety and is safely used.

2. Second Embodiment

[2-1. Configuration of Headphone]

Next, a second embodiment of the present technology will be described. A smart glass 10A according to the second embodiment includes a glass portion 100, a left-side headphone 200A, and a right-side headphone 300A. Since the configuration of the glass portion 100 is similar to that in the first embodiment, the description thereof will be omitted. Hereinafter, description on the headphones will be made with reference to the left-side headphone 200A. The configurations of the left-side headphone 200A and the right-side headphone 300A are the same except that both headphones are symmetrical.

Figure 5:
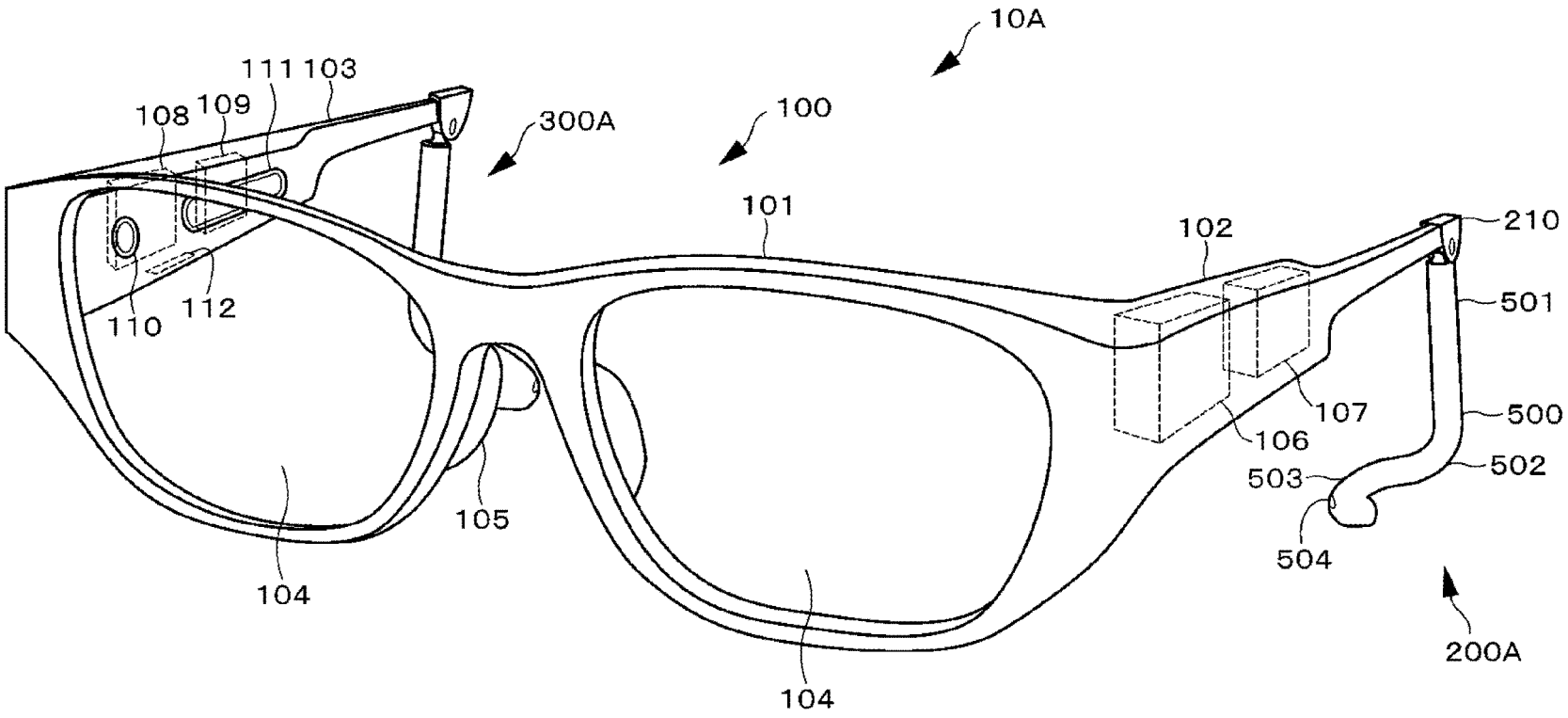
FIG. 5 is a perspective view illustrating a configuration of a smart glass including headphones according to a second embodiment.

As illustrated in FIG. 5, the left-side headphone 200A according to the second embodiment includes a hinge portion 210 and a sound emission unit 500. Note that the hinge portion 210 is similar to that in the first embodiment.

In the second embodiment, the left-side headphone 200A does not include a housing having a diameter larger than that of the sound emission unit 500, and the sound emission unit 500 is formed to have a tubular shape from a substantially linear driver container 501, a first curved portion 502, and a second curved portion 503. A sound emission hole 504 is formed in the second curved portion 503. Note that the configurations of the first curved portion 502, the second curved portion 503, and the sound emission hole 504 are respectively similar to the first curved portion 231, the second curved portion 232, and the sound emission hole 233 according to the first embodiment.

Figure 6:
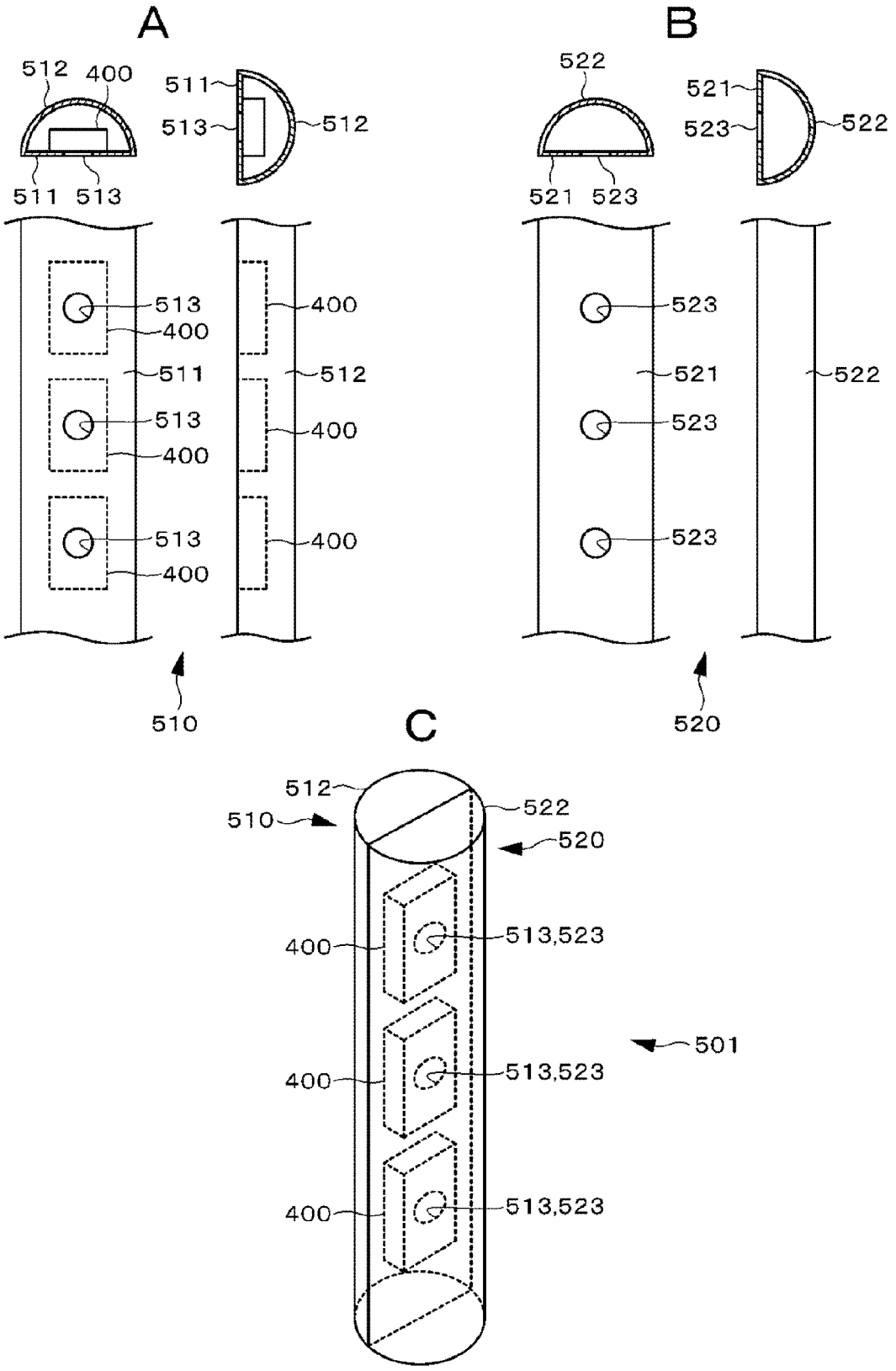
FIG. 6 is an exploded view illustrating a configuration of a sound emission unit of the headphone according to the second embodiment.

The sound emission unit 500 functions as a sound guide tube for guiding sound from a balanced armature-type driver 400 and functions as a support mechanism of the smart glass 10A. The plurality of balanced armature-type drivers 400 is aligned in series in the driver container 501 of the sound emission unit 500 according to the second embodiment (portion which functions as sound guide tube). The driver container 501 includes a driver side portion 510 and a front surface portion 520. FIG. 6A is a plan view, a front view, and a side view of the driver side portion 510, FIG. 6B is a plan view, a front view, and a side view of the front surface portion 520, and FIG. 6C is a perspective view of the driver container 501 configured by combining the driver side portion 510 and the front surface portion 520.

The driver side portion 510 is formed in a cylindrical shape, having a semicircular shape in plane view, including a flat portion 511 and a semicircular portion 512. Similarly, the front surface portion 520 is formed in a cylindrical shape, having a semicircular shape in plane view, including a flat portion 521 and a semicircular portion 522. Note that, although not illustrated, since the first curved portion 502 and the second curved portion 503 are integrally formed with the driver container 501, each of these curved portions includes a flat portion and a semicircular portion.

A plurality of sound output holes 513 is formed in the flat portion 511 of the driver side portion 510 in series along a length direction of the driver container 501. Furthermore, a plurality of sound output holes 523 is formed in the flat portion 521 of the front surface portion 520 at a position corresponding the position of the sound output hole 513 in the flat portion 511 in series along the length direction of the driver container 501. In the example illustrated in FIG. 6, three sound output holes 513 and three sound output holes 523 are formed. By combining the flat portion 511 and the flat portion 521, the driver side portion 510 and the front surface portion 520 integrally form the cylindrical sound emission unit 500.

The sound emission holes 530 which emit sound from the sound emission unit 500 toward the external acoustic opening of the user are formed on the side of the front surface portion 520.

In the driver side portion 510, the balanced armature-type drivers 400 are provided in series at positions respectively corresponding to the sound output holes 513. The sound output from the balanced armature-type driver 400 is emitted into the front surface portion 520 through the sound output holes 513 and the sound output holes 523, transmitted through the front surface portion 520, and emitted from the sound emission holes 530 toward the external acoustic opening of the user. This configuration allows the user to listen to the sound output from the headphones.

Since the balanced armature-type driver can be smaller than the dynamic-type driver, it is not necessary to provide the housing for containing the driver as in the first embodiment, and the balanced armature-type driver can be directly provided in the sound emission unit 500.

However, there are problems such that the balanced armature-type driver has lower volume and less powerful bass than the dynamic-type driver or the like. Therefore, in the present embodiment, by providing the plurality of balanced armature-type drivers in series, the problems in the volume and sound quality are solved.

The headphone according to the second embodiment is configured as described above. According to the second embodiment, by using the balanced armature-type driver which can be miniaturized in comparison with the dynamic-type driver, the headphone can be miniaturized.

3. Modification

The embodiments of the present technology have been specifically described above. However, the present technology is not limited to the above-mentioned embodiments, and various kinds of variations on the basis of technical ideas of the present technology are possible.

Figure 7:
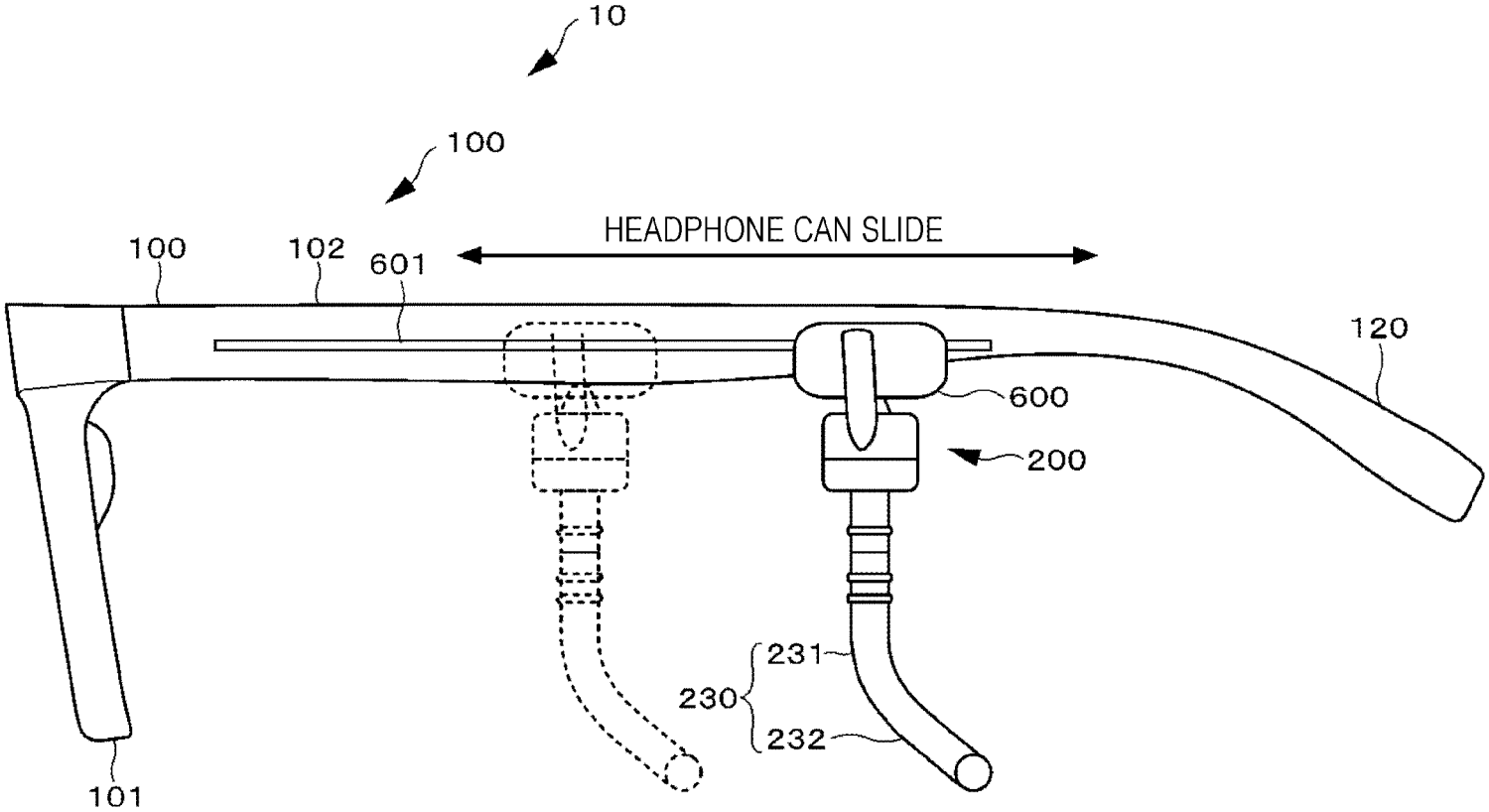
FIG. 7 is a side view illustrating a headphone according to a modification.

Instead of the hinge portion 210 as the operation unit described in the first embodiment, a slider 600 which can adjust the position of the left-side headphone 200 by sliding along the temple may be used as illustrated in FIG. 7. The slider 600 is fitted into a groove 601 provided in the left-side temple 102 to as to slide. Note that the similar applies to the right-side temple 103. In a case where the slider 600 is used, only the position of the sound emission unit 230 in the horizontal direction is changed by the slide of the slider 600, and the position in the height direction is not changed. Therefore, even if the glass portion 100 includes moderns 120, the slide of the slider 600 does not shift the contact position between the modern 120 and the ear and does not make the glass portion 100 be unstable. Therefore, as illustrated in FIG. 7, the glass portion 100 may include the moderns 120. Note that, in a case where the operation unit is the slider 600, the glass portion 100 does not need to include the moderns.

Figure 8:
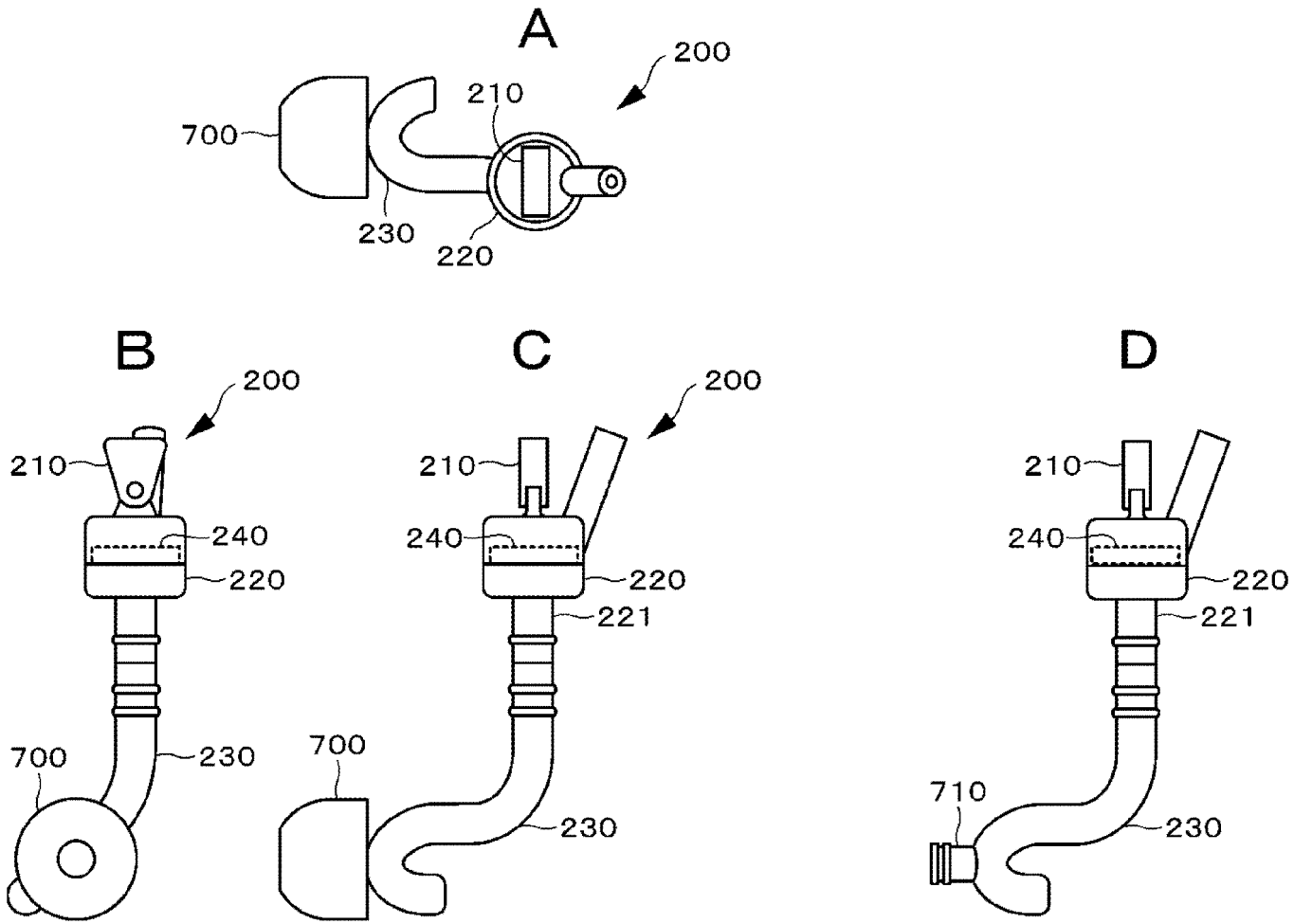
FIG. 8 is a view illustrating a headphone according to a modification.

As illustrated in FIG. 8, a canal-type earpiece 700 may be attached to the sound emission unit 230. Since the canal-type earpiece 700 is deeply inserted into the external acoustic opening of the user, the user can listen to powerful sound while supporting the smart glass 10 by providing the canal-type earpiece 700. Note that, in this case, as illustrated in FIG. 8D, it is necessary to provide a cylindrical projection 710 on the sound emission unit 230 used to attach the canal-type earpiece 700 to the sound emission unit 230.

Furthermore, the user may be able to attach the canal-type earpieces according to user environment. For example, in a case where it is not necessary to listen to external sound in a limited space such as a house and the user desires to listen to powerful sound, the user can listen to the powerful sound by attaching the canal-type earpieces to the headphones.

Instead of the power button and the volume button as the operation units provided on the temple of the glass portion 100, a touch panel may be provided which can turn on/off the power, adjust the volume, and perform other operations. Furthermore, a position where the operation unit is provided is not limited to the inner surface of the temple, and the operation unit may be provided on any one of the outer side surface, the top surface, and the bottom surface.

In the first embodiment, the description has been made as assuming that the driver unit is the dynamic-type driver, and in the second embodiment, the description has been made as assuming that the driver unit is the balanced armature-type driver. However, the driver unit is not limited to these drivers. Other type of the driver unit may be used. Furthermore, the balanced armature-type driver may be used in the first embodiment, and the dynamic-type driver may be used in the second embodiment.

In the embodiments, the description has been made as using the smart glass 10 including the displays 104 as an example. However, normal glasses which do not include the displays may include the headphones according to the present technology. In this case, the glasses or the headphones are connected to an external sound output device (smartphone, module music player, and the like) by a communication function such as a Bluetooth (registered trademark) module, and sound data transmitted from the sound output device is output as sound.

The display of the glass portion 100 may be a device which does not have a function as a normal glass and blocks user's visual recognition (for example, VR device or the like).

The present technology may have a configuration below.

(1) A headphone including:

a sound emission unit supported by a temple included in a glass portion including a display and/or a lens and to be inserted into a concha cavity of a user's ear.

(2) The headphone according to (1), in which the sound emission unit is formed in a tubular shape.

(3) The headphone according to (1) or (2), in which the sound emission unit includes a first curved portion that is curved in a direction toward the concha cavity of the user and a second curved portion that is curved in a substantially U-like shape and has contact with the concha cavity.

(4) The headphone according to (3), in which a sound emission hole is provided in the second curved portion.

(5) The headphone according to (3), in which the sound emission unit is inserted into an inside of the ear inner than a user's ear tragus and has contact with the concha cavity.

(6) The headphone according to any one of (1) to (5), in which the sound emission unit is formed to have flexibility.

(7) The headphone according to any one of (1) to (6), in which the glass portion does not include a modern at an end of the temple, and the sound emission unit is supported by the end of the temple.

(8) The headphone according to any one of (1) to (7), in which the sound emission unit is supported by the temple via an operation unit.

(9) The headphone according to (8), in which the operation unit includes a hinge mechanism and rotates so as to adjust a position of the sound emission unit.

(10) The headphone according to (8), in which the operation unit includes a slide mechanism and slides so as to adjust a position of the sound emission unit.

(11) The headphone according to any one of (1) to (10), in which the sound emission unit includes a dynamic-type driver.

(12) The headphone according to any one of (1) to (12), in which the sound emission unit includes a balanced armature-type driver.

(13) The headphone according to (12), in which a plurality of the balanced armature-type drivers is provided in a sound guide tube in series.

(14) The headphone according to any one of (1) to (13), in which an earpiece is capable of being attached to the sound emission unit.

(15) A headphone including:

a glass portion including a display and/or a lens; and a sound emission unit supported by a temple of the glass portion and to be inserted into a concha cavity of a user's ear.

REFERENCE SIGNS LIST

10, 10A Smart glass
100 Glass portion
102 Left-side temple
103 Right-side temple
200, 200A Left-side headphone
210 Hinge portion
230 Sound emission unit
231 First curved portion
232 Second curved portion
233 Sound emission hole
240 Dynamic-type driver
300, 300A Right-side headphone
400 Balanced armature-type driver
600 Slider
700 Earpiece

What is claimed is:

1. A headphone, comprising:

a sound emission unit supported by a temple of a glass portion, wherein the glass portion includes at least one of a display or a lens, wherein the sound emission unit is configured to be inserted into a concha cavity of a user's ear, wherein the sound emission unit is supported by the temple via an operation unit, and wherein the operation unit includes a hinge mechanism and rotates so as to adjust a position of the sound emission unit.

2. The headphone according to claim 1, wherein the sound emission unit is formed in a tubular shape.

3. The headphone according to claim 1, wherein the sound emission unit includes a first curved portion that is curved in a direction toward the concha cavity of the user's ears and a second curved portion that is curved in a substantially U-like shape and has contact with the concha cavity of the user's ear.

4. The headphone according to claim 3, wherein
a sound emission hole is provided in the second curved portion.

5. The headphone according to claim 3, wherein
the sound emission unit is inserted into an inside of the user's ear further than a user's ear tragus and has contact with the concha cavity of the user's ear.

6. The headphone according to claim 1, wherein
the sound emission unit is formed to have flexibility.

7. The headphone according to claim 1, wherein
the glass portion does not include a modern at an end of the temple, and the sound emission unit is supported by the end of the temple.

8. The headphone according to claim 1, wherein
the sound emission unit includes a dynamic-type driver.

9. The headphone according to claim 1, wherein
an earpiece is capable of being attached to the sound emission unit.

10. A headphone, comprising:
a sound emission unit supported by a temple of a glass portion,
wherein the glass portion includes at least one of a display or a lens,
wherein the sound emission is configured to be inserted into a concha cavity of a user's ear,
wherein the sound emission unit includes a balanced armature-type driver, and
wherein a plurality of the balanced armature-type drivers is provided in a sound guide tube in series.

11. The headphone according to claim 10, wherein the sound emission unit is formed in a tubular shape.

12. The headphone according to claim 10, wherein the sound emission unit includes a first curved portion that is curved in a direction toward the concha cavity of the user's ear and a second curved portion that is curved in a substantially U-like shape and has contact with the concha cavity of the user's ear.

13. The headphone according to claim 12, wherein a sound emission hole is provided in the second curved portion.

14. The headphone according to claim 12, wherein the sound emission unit is inserted into an inside of the user's ear further than a user's ear tragus and has contact with the concha cavity of the user's ear.

15. The headphone according to claim 10, wherein the sound emission unit is formed to have flexibility.

16. The headphone according to claim 10, wherein the glass portion does not include a modern at an end of the temple, and the sound emission unit is supported by the end of the temple.

17. The headphone according to claim 10, wherein the sound emission unit is supported by the temple via an operation unit.

18. The headphone according to claim 17, wherein the operation unit includes a slide mechanism and slides so as to adjust a position of the sound emission unit.

19. The headphone according to claim 10, wherein an earpiece is capable of being attached to the sound emission unit.

20. A headphone, comprising:
a glass portion including at least one of a display a lens; and
a sound emission unit supported by a temple of the glass portion and configured to be inserted into a concha cavity of a user's ear,
wherein the sound emission unit is supported by the temple via an operation unit, and
wherein the operation unit includes a hinge mechanism and rotates so as to adjust a position of the sound emission unit.

* * * * *